US006230628B1

(12) United States Patent
Farnell et al.

(10) Patent No.: US 6,230,628 B1
(45) **Date of Patent: *May 15, 2001**

(54) INFRARED ILLUMINATION COMPOSITIONS AND ARTICLES CONTAINING THE SAME

(75) Inventors: Patricia L. Farnell, Morehead, KY (US); Russell Broad, Passaic; Stuart Nemiroff, Rockaway, both of NJ (US)

(73) Assignee: The United States of America as represented by the Secretary of the Army, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/182,029

(22) Filed: Oct. 29, 1998

(51) Int. Cl.[7] ..... F42B 4/26; F42B 4/00

(52) U.S. Cl. ..... 102/336; 149/116; 149/94; 149/95; 149/45; 102/335

(58) Field of Search ..... 102/336; 149/94, 149/95, 116, 45

(56) References Cited

U.S. PATENT DOCUMENTS

| | | | | |
|---|---|---|---|---|
| 3,733,223 | * | 5/1973 | Lohkamp | 149/116 |
| 3,888,177 | * | 6/1975 | Tyroler | 149/116 |
| 4,078,954 | * | 3/1978 | Bernardy | 149/116 |
| 4,452,039 | * | 6/1984 | Hodgkins | 102/336 |
| 5,056,435 | * | 10/1991 | Jones et al. | 102/336 |
| 5,520,756 | * | 5/1996 | Zeigler | 149/19.8 |
| 5,587,552 | * | 12/1996 | Dillehay et al. | 149/19.5 |
| 5,652,409 | * | 7/1997 | Thompson et al. | 149/98 |
| 5,813,219 | * | 9/1998 | Gill et al. | 60/223 |
| 5,912,430 | * | 6/1999 | Nielson | 149/19.1 |

FOREIGN PATENT DOCUMENTS

| | | | |
|---|---|---|---|
| 1277528 | * | 6/1972 | (GB) . |
| 1515039 | * | 6/1978 | (GB) . |

* cited by examiner

*Primary Examiner*—Michael J. Carone
*Assistant Examiner*—Glenda L. Sánchez
(74) *Attorney, Agent, or Firm*—Robert Beam; John F. Moran; Michael Sachs

(57) ABSTRACT

An infrared illuminating composition comprising approximately 70 weight % of an oxidant evidencing strong emission in the NIR region selected from the group consisting of potassium nitrate, cesium nitrate and mixtures thereof; 9 weight % of a metallic fuel evidencing low visible light emission, 4 weight % of an epoxy resin binder, 16 weight % of a NIR light enhancer and 1% by weight of an additive selected from the group consisting of a double base propellant material, a triple base propellant material and mixtures thereof.

3 Claims, No Drawings

INFRARED ILLUMINATION COMPOSITIONS AND ARTICLES CONTAINING THE SAME

The U.S. Army has certain rights and licenses in the above invention by grant from the above inventors.

This invention concerns covert flare articles, compositions and systems; these are for situations which use infra-red night vision techniques. There are two common types of night vision systems; one type uses special goggles that amplify the existing light. The other type uses a flare which has a payload or candle that burns and emits near infra red (NIR) illumination. This is used in combination with infra red sensitive night vision goggles. For the infra-red systems to be useful as covert illumination systems, the flares should desirably have a high IR output, a fast burn time and a very favorable IR/visible light ratio. It is also important that chunking of the burning flare composition be controlled. The United States Navy has developed one such system which uses a flare known as Black Knight. Thiokol Corporation has reported a system known as Thiolite which is described in U.S. Pat. No. 5,056,435, Jones et al, Oct. 15, 1991. There are deficiencies in these systems in that the Black Knight flare has a relatively long burn time, a low intensity of infra red illumination and a low IR/visible ratio. The reported product from Thiokol Corporation included boron to increase the burn rate and increase intensity. These used potassium nitrate or potassium perchlorate as oxidizers. The IR/visible ratio was not improved and chunking was observed. There is need for an improved night vision flare and system using the flare.

The improved covert flares of this invention have increased intensity of NIR illumination, fast burn rates and a very favorable IR/visible ratio. The combination of these properties has resulted in substantial improvement and acceptability of the flares of this invention. It has been found that the conventional flare infra-red candle composition can be modified to increase the burn rate while maintaining a substantially uniform burning of the candle, without substantial chunking or subdivision into embers. In terms of the chemical compositions of the candle of the flares, the invention uses a small amount of an additive selected from the group consisting of a primary energetic material, a single base propellant material, a double base propellant material, a triple base propellant material and mixtures thereof to significantly improve the properties of conventional NIR flares. It is likely that the mechanism of the action of the additive in the candle composition is to increase the surface which is burning and, to some extent, cause an expulsion of composition from the flare while the flare is burning. The effect of the additive is to increase burn rate and increase NIR output while keeping a favorable IR/visable light ratio and avoiding chunking.

A desired formulation will use an oxidant with strong emission in the near infra red, such as cesium nitrate or mixtures in which cesium nitrate is the major ingredient such as cesium nitrate and potassium nitrate; a metallic fuel with low visible light emission, such as silicon; a near infra-red emission enhancer, such as hexamine; a binder such as a nitrogen containing epoxy resin and a small amount of the additive. Nitrocellulose based additives are preferred materials because they do not decompose under shear as is the tendency with black powder and red powder.

Materials such as black powder or red powder are examples of the primary energetic materials. Nitrocellulose with or without a plasticizer is a traditional single base propellant material. A suitable double base propellant material is nitrocellulose and nitroglycerin. A suitable triple base propellant material is nitrocellulose, nitroglycerin and nitroguanidine. These are effective in small amounts so that the benefits of the invention can be attained without causing a major change in the basic infrared candle composition and structure. The small amounts are in the range of about 1% by weight, the amount can be increased or decreased for particular burn rates and burn times. The beneficial effect of this additive is readily apparent when flares are tested and the proportion of additive can be adjusted to achieve the desired burning rate, burning time and near infra-red intensity.

The overall night vision system has a delivery system for the flare such as a mortar, an artillery round, a rocket or a bomb. One or more flares are delivered to the target area; these flares will be of conventional construction which includes a housing, an ignition train, a propellant charge and the candle or payload with the flare composition. The burning flare illuminates the target area with the high intensity NIR. The highly illuminated target area can be seen through infra red sensitive night vision goggles. At the same time the low visible light output will cause the flare to be virtually invisible to the unaided eye. This is very important for a successful covert operation.

In terms of the mechanical construction of the flares, these are typical of the types in current use such as the M721 and XM 721 Illumination Flares; the military specifications give the details of the assembly and construction of the flares. The composition of the invention is used in what is known as the candle or payload.

In terms of sizes, the invention can be applied to any conventional payload delivery system. A preferred range of current weapon sizes are 40, 60, 81 and 120 mm. rounds. These can be fired by gun or mortar or can be hand held signals such as the 40 mm. The invention has an advantage in that the faster burn time of the composition allows for additional volume in the candle. The excess volume can be filled with an inert material for matching ballistic performance or the active ingredient to provide greater illumination intensity or burn time. The burn time range is about 40 to 90 seconds. It should be understood that the elevation of the flare during burning affects the area which is illuminated and the time available for the burn time of the flare.

As particular examples of the invention, the following table summarizes examples of the compositions and properties of flares made in accordance with the invention.

| A) Ingredient | Chemical | wt. % |
|---|---|---|
| fuel | Silicon metal | 9 |
| oxidizer | Cesium nitrate | 70 |
| binder | Epoxy Resin, Epon 828 | 4 |
| NIR enhancer | Hexamine | 16 |
| ADDITIVE | Nitrocellulose | 1% |
| Burn Time (sec) | 17.67 | |
| Burn Rate | 0.042 | |
| NIR intensity (w) | 44.8 | |
| NIR Eff. (w-s/g) | 22.6 | |
| Vis Intensity (c) | 156.4 | |
| Eff (2-c/g) | 78.9 | |
| IR/VIS | 0.286 | |

| B) Ingredient | Chemical | wt. % |
|---|---|---|
| fuel | Silicon metal | 9 |
| oxidizer | Cesium nitrate | 40 |
| | Potassium Nitrate | 30 |
| binder | Epoxy Resin, Epon 828 | 4 |

-continued

| | | |
|---|---|---|
| NIR enhancer | Hexamine | 16 |
| ADDITIVE | Nitrocellulose | 1% |
| Burn Time (sec) | 30.41 | |
| Burn Rate | 0.0289 | |
| NIR intensity (w) | 36.0 | |
| NIR Eff. (w-s/g) | 31.0 | |
| Vis Intensity (c) | 134.6 | |
| Eff (2-c/g) | 116.1 | |
| IR/VIS | 0.267 | |

| C) Ingredient | Chemical | wt. % |
|---|---|---|
| fuel | Silicon metal | 9 |
| oxidizer | Cesium nitrate | 70 |
| binder | Epoxy Resin, Epon 828 | 4 |
| NIR enhancer | Hexamine | 16 |
| ADDITIVE | Black Powder, cl 7 | 1% |
| Burn Time (sec) | 19.61 | |
| Burn Rate (/sec) | 0.44 | |
| NIR intensity (w) | 41.3 | |
| NIR Eff. (w-s/g) | 23.1 | |
| Vis Intensity (c) | 143 | |
| Eff (2-c/g) | 80.1 | |
| IR/VIS | 0.289 | |

| D) Ingredient | Chemical | wt. % |
|---|---|---|
| fuel | Silicon metal | 9 |
| oxidizer | Cesium nitrate | 40 |
| | Potassium Nitrate | 30 |
| binder | Epoxy Resin, Epon 828 | 4 |
| NIR enhancer | Hexamine | 16 |
| ADDITIVE | Nitrocellulose | 1% |
| Burn Time (sec) | 17.49 | |
| Burn Rate | 0.050 | |
| NIR intensity (w) | 50.3 | |
| NIR Eff. (w-s/g) | 25.1 | |
| Vis Intensity (c) | 174 | |
| Eff (2-c/g) | 87.1 | |
| IR/VIS | 0.2 | |

The Nitrocellulose was a conventional single base propellant material and had about 13% Nitrogen. The black powder was added at the end of the mixing cycle because it breaks up under shear. Red powder has a similar behavior.

It should be understood that the flares are prepared by forming a mixture of the ingredients and then pressing this mixture into a container which forms the candle. After mixing the initial ingredients, the composition should be free of solvent for best results. The ingredients in the article can be pressed from top to bottom of from bottom to top. The pressure of pressing will be about 7,000 psi.

The techniques for measurement of the visible and the near infra red intensity of the flares while burning in test tunnels are described in the following enclosures:

(A) Testing Related to Covert Composition Development, Gene D. Venable.

(B) Testing of M721 60 mm Illumination Mortar, pps 1–8 Crane Army Ammunition Activity.

(C) Testing of XM767 60 mm IR GEN3 Covert Black Knight, Crane Army Ammunition Activity.

A typical formulation for batches of covert infra red composition are shown on the enclosure INFRA RED COMPOSITIONS, TYPICAL, p. 44, Crane Army Ammunition Activity, Standard Operating Procedure, CN-0000-N-062, July 1995. With these procedures, the compositions of this invention can be readily prepared in different sizes. For example, the flares can be made up in the form of rounds to fit 40mm, 60 mm., 81 mm or 120 mm mortars.

The flares are capable of producing a large amount of radiation in the near infra red region of about 0.75 to 1.0 microns. The effect of the additive is to impart a faster burning rate which increases the intensity of the NIR illumination. The additives may be used separately or in combination with each other. It is easiest to fabricate the compositions when nitrocellulose based propellant materials are used. For the balance of the candle composition, the preferred ingredients will also include a major amount of the cesium nitrate oxidizer, a minor amount of a potassium nitrate or chlorate oxidizer, a small amount of metal fuel such as about 5 to 15 wt. % of silicon metal, an amount of hexamine sufficient to enhance emission in the NIR region, about 16%, and a binder in about 4 wt %. A suitable binder is amine curable, aromatic based epoxy resin.

We claim:

1. Infrared illuminating composition comprising approximately 70 weight % of an oxidant evidencing strong emission in the NIR region., 9 weight % of a metalallic fuel evidencing low visible light emission, 4 weight of an epoxy resin binder, 16 weight % of a NIR light enhancer and 1% by weight of an additive selected from the group consisting of a double base propellant material, a triple base propellant material and mixtures thereof.

2. Composition in accordance with claim 1 wherein the oxidant comprises 40 weight % cesium nitrate, remainder potassium nitrate.

3. Composition in accordance with claim 1 wherein the oxidant is cesium nitrate.

* * * * *